United States Patent [19]

Waters et al.

[11] Patent Number: 4,825,225

[45] Date of Patent: Apr. 25, 1989

[54] HYPERBOLOIDAL DEPLOYABLE SPACE ANTENNA

[76] Inventors: Terrance J. Waters; Michael T. Waters, both of 33560 Mulholland Hwy., Malibu, Calif. 90265

[21] Appl. No.: 6,741

[22] Filed: Jan. 27, 1987

[51] Int. Cl.[4] ..... H01Q 1/08; H01Q 15/20

[52] U.S. Cl. ..... 343/881; 343/915

[58] Field of Search ..... 343/915, DIG. 2, 878, 343/880, 881, 882, 840, 912; 350/608

[56] References Cited

U.S. PATENT DOCUMENTS

| | | | |
|---|---|---|---|
| 3,509,576 | 4/1970 | McLain | 343/915 |
| 3,618,111 | 11/1971 | Vaughan | 343/915 |
| 3,618,277 | 11/1971 | Waters | 52/175 |
| 3,631,505 | 12/1971 | Carman et al. | 343/915 |
| 3,680,144 | 7/1972 | Low et al. | 343/915 |
| 4,152,708 | 5/1979 | Boucher | 343/880 |

FOREIGN PATENT DOCUMENTS

| | | | |
|---|---|---|---|
| 502431 | 4/1976 | U.S.S.R. | 343/DIG. 2 |

*Primary Examiner*—William L. Sikes
*Assistant Examiner*—Michael C. Wimer
*Attorney, Agent, or Firm*—William W. Haefliger

[57] ABSTRACT

A deployable hyperboloidal antenna includes:

(a) a first framework including multiple frame members extending along the ruled lines or directrices of an hyperboloid of revolution, (b) the members having pivotal interconnections at intersections of said ruled lines or directrices, (c) whereby the framework is deployable between collapsed and expanded conditions.

14 Claims, 4 Drawing Sheets

HYPERBOLOIDAL DEPLOYABLE SPACE ANTENNA

BACKGROUND OF THE INVENTION

This invention relates generally to deployable structures, which may serve for example as antennae, as in space; and more particularly it concerns a rapidly deployable hyperboloidal antenna structure, expansible from collapsed condition (as during launching from earth) to expanded condition, for service as an antenna or reflector, or for similar uses, such as a hyperboloidal structural framework for a space vehicle, artificial satellite or a structure for a machine housing or human habitat on a moon, asteroid or planet.

Throughout history, architects and engineers have sought to design support and bracing systems to withstand stresses within members caused by external forces. These stresses are: tension, compression, shear and torsion, usually acting in combination, giving flexure or bending. These stresses are accentuated in large structures where horizontal stresses become more important than vertical stresses.

One unique geometric shape which can be used as a structure acting to eliminate horizontal forces is that conforming to an hyperboloid of revolution of one sheet, and characterized in that horizontal and vertical forces are transformed into axial forces acting up or down the ruled line truss members in compression or tension, i.e. along directrices or ruled lines of the structure.

The hyperboloid of revolution of one sheet is further characterized by:

(1) the only surface which is both a warped surface and a surface of revolution, (2) a ruled surface generated by revolving a straight line about an axis that is not in the same plane, (3) may also be generated by revolving an hyperbola about an axis in the plane of the curve and which is the perpendicular bisector of a line joining the foci, (4) a peculiar property of the hyperboloid of revolution of one sheet and of the hyperbolic paraboloid is that: through any point on the surface there pass two distinct straight lines which lie entirely in the surface. These lines are called rulings and surfaces which contain rulings are called ruled surfaces. (Note: the hyperbolic paraboloid is not a surface of revolution).

If a structure is constructed in the shape of an hyperboloid of revolution of one sheet and if all support is by members lying along the ruled lines, as in this invention, then it follows that:

(a) all forces are eliminated except axial forces in the structures, which is a new principle, (b) the ruled line truss members serve two simultaneous purposes: namely, vertical support and also bracing.

The forces which are eliminated are shear and torsion, leaving only tension and compression. Then if the ruled line members are designed so as to be considered as compression members, the structure must fail first in compression before it can go into tension (under the force of gravity or while undergoing acceleration or deceleration). Therefore, in effect, tension is also eliminated, leaving only the force of compression. This geometry works with natural forces instead of against them. The resulting structure is mathematically determinate and requires no stressing nor destruction testing of models to prove its structural integrity. In space, while in orbit under so-called "free fall", the structure would be subject to axial forces only, i.e., tension and compression acting along the same lines equal and opposite.

Extending the discussion to satellites, and in recognition of the above, there is need for a unitary antenna, reflector or other structure which is easily deployable in space and can utilize the unusually advantageous structural principles of an hyperboloid of revolution.

SUMMARY OF THE INVENTION

It is a major object of the invention to provide means meeting the above need. Basically, the hyperboloidal, deployable antenna or reflector structure comprises:

(a) a first framework including multiple frame members extending along the ruled lines or directrices of an hyperboloid of revolution, (a directrix is a ruled line which when revolved about a central axis will generate the entire surface of revolution), (b) the members having pivotal interconnections at intersections of said directrices, or ruled lines, (c) whereby the framework is deployable between collapsed and expanded conditions and can be collapsed or expanded repeatedly if desired.

Further, there may typically be electromagnetic wave antenna or reflector surfaces on or carried by the framework; each member may have pivotal connection with at least two other members, at locations spaced along the length of each member; and the pivotal connection locations may include a first location and second location, said first location defining a first plane normal to an axis defined by the hyperboloid of revolution and the second location defining a second plane normal to said axis, said first and second planes having relatively greater axial spacing therebetween in said collapsed condition of the framework, and relatively lesser spacing therebetween in said expanded condition of the framework. There may be three or four pivotal connections of each member to other members; also, actuator means may be connected with the framework to displace it between collapsed and extended positions, as will be seen.

Typical parts of the structure are members which deploy or expand to form rigid tubes pre or poststressed, joining the points where the hyperboloidal members running along the ruled lines cross. These members complete the hyperboloidal structural connections to make the new structural principle operate. Such force connection can also be provided by compression or tension loading in a longitudinal direction.

A further object is to form the elongated members as lightweight tubes, which may be placed in compression, lengthwise, as by internal means, one example being flexible lines within the tubes and maintained in tension (prestressing or poststressing).

It is a further object of the invention to provide a second framework including multiple frame members having pivotal attachment to one another and also to members of the first framework, whereby the second framework is also deployable between multiple positions as the first framework is deployed between said collapsed and expanded conditions. The framework may define a common central axis, and the second framework members may extend closer along their major lengths to said axis than the members of said first framework along their major lengths, in said expanded condition of the first framework. The second framework may carry electromagnetic wave transmission means located to receive or transmit electromagnetic waves reflected by the electromagnetic wave antenna surfaces on the first framework members.

Additional objects include the carriage of electronic circuitry by the collapsible and expansible members, in spaces between the members; and the provision of an elongated container which can be made from "stealth" materials removably carrying said framework in collapsed condition, and adapted to be projected into space, the framework then being separable from said container for deployment into expanded condition.

In summary, a major purpose of this invention is to use hyperboloidal geometry and hyperboloidal structural advantages to make possible deployment of large space antennae for transmitting and receiving electromagnetic radiation for communication, radar, passive surveillance or as a weapon in space. Advantages also include:

(a) provision of large size and at the same time very light weight (up to 90% less) hyperboloidal antenna to be contained in a small diameter tube or container for trans-orbital insertion, (b) the antenna is rapidly self-deployable and can be folded back up and stored in the small container for use at any time, (c) the hyperboloidal antenna is extraordinarily strong and stiff, as in use as a structural system on earth, under gravity and horizontal loads, while being very light, (d) when opened or closed the device can withstand high G forces, (e) use of all compression members in prestressed condition to resist tension and compression from any direction while resolving all forces into axial loads, (f) use of the antenna structure as a habitat and/or equipment bay, (g) antenna sub-assemblies such as: wiring, power modules, emitters, receptors, computers, attitude-control rockets, fuel tank and all other components can be permanently mounted in structure folded configuration and functionally connected so they are always ready for use, (h) because of its high geometric and structural redundancy, the structure will withstand extensive damage and can still remain operational, (i) use of electronic means to shape the electromagnetic wave to match the hyperboloidal structural geometry providing structure that is the antenna, operating with extremely high efficiency.

These and other objects and advantages of the invention, as well as the details of an illustrative embodiment will be more fully understood from the following specification and drawings, in which:

DRAWING DESCRIPTION

FIG. 1 is an elevational view showing a collapsed condition of a framework incorporating the invention;

FIG. 1*a* is an elevation showing storage of the collapsed framework in a container, for deployment in space;

DETAILED DESCRIPTION

Figure 1:
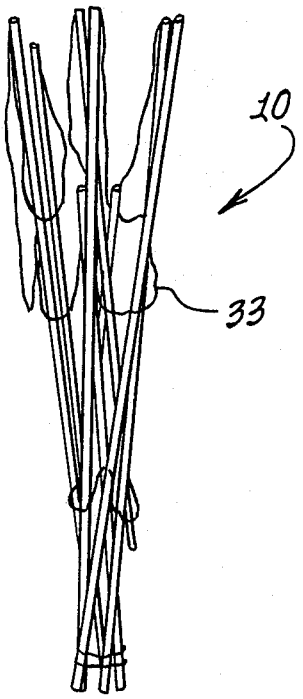
Figure 2:
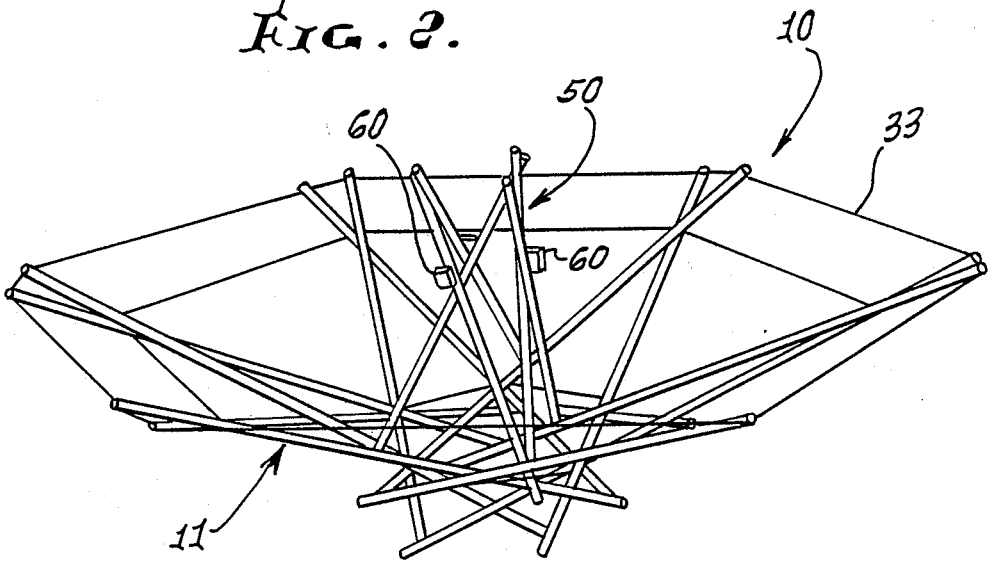
FIG. 2 is a perspective view, principally in elevation, showing completed expansion of the framework.
Figure 3:
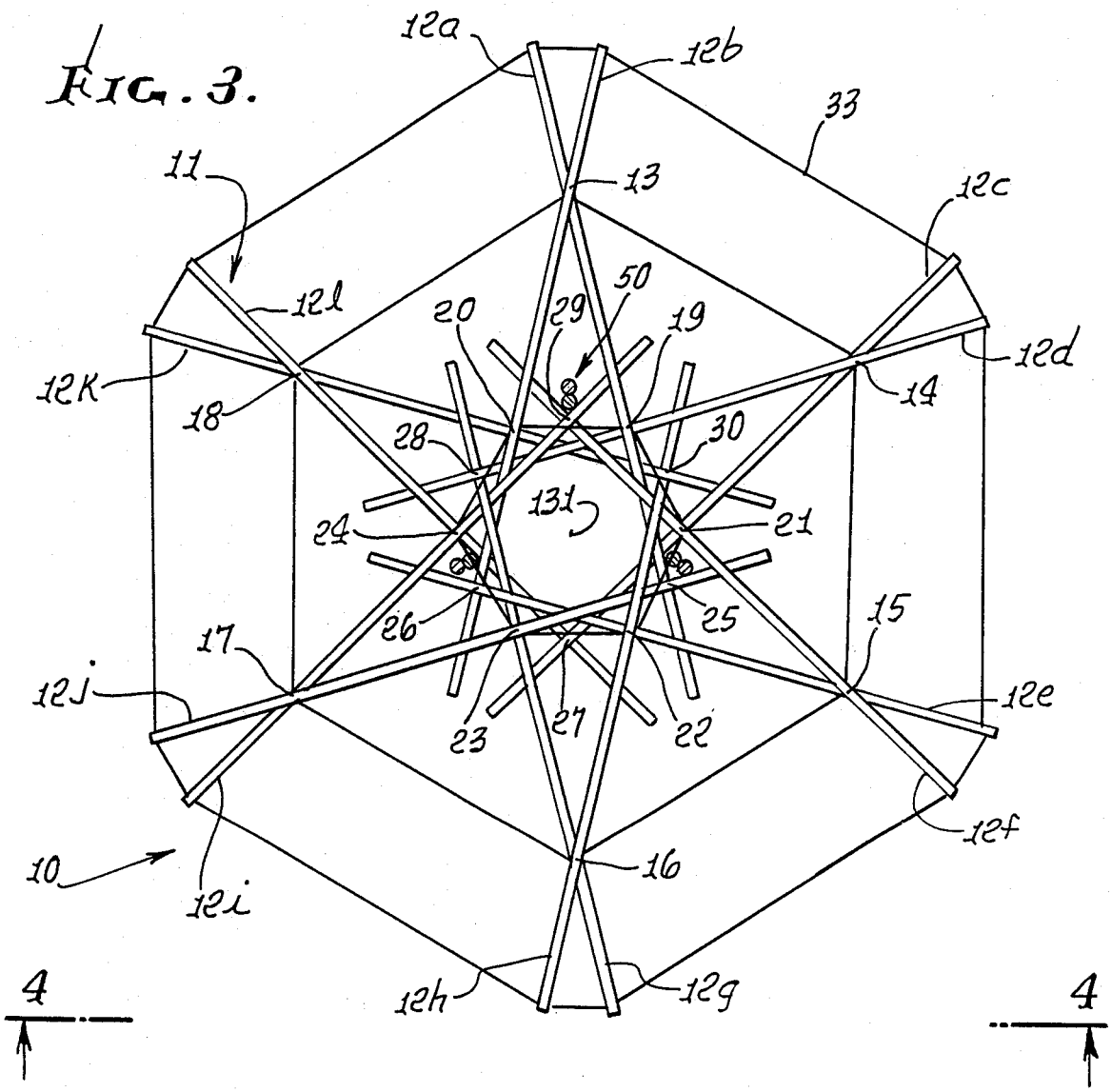
FIG. 3 is a top plan view of the framework in completed expanded state.
Figure 10:
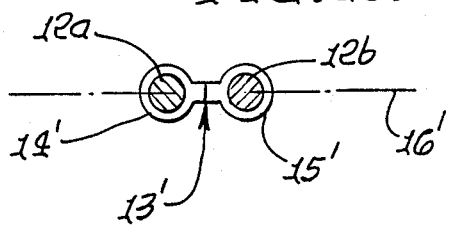
FIG. 10 is a section showing a pivot connection between two members.

The hyperbolodial deployable antenna 10 seen in FIG. 1 is collapsed and as seen in FIGS. 2 and 3 is fully expanded. It includes a first framework 11 that includes multiple frame members 12*a* and 12*b*, 12*c* and 12*d*, 12*e* and 12*f*, 12*g* and 12*h*, 12*i* and 12*j*, and 12*k* and 12*l*. The members of each pair, as grouped, have pivotal interconnections at 13–18 at intersections of hyperboloidal directrices along which the members extend; and in this regard, members 12*a*, 12*c*, 12*e*, 12*g*, 12*i* and 12*k* extend in a clockwise directrix conformation about the central axis 13*l* of the structure, whereas members 12*b*, 12*d*, 12*f*, 12*h*, 12*j* and 12*l* extend in a counterclockwise directrix conformation about the axis of the structure. Thus, the members are pivotally interconnected at intersections of clockwise directrices with counterclockwise directrices. FIG. 10 shows one form of pivotal interconnection as between members 12*a* and 12*b*, to include bands 14' and 15' locally encircling the members (allowing rotation of members within bands) and pivotally interconnected at joint 13', to allow relative pivoting about a pivot axis 16'.

In addition, each member preferably has pivotal interconnection with at least two other members, and typically with at least three members, in all. See the following pivotal connection organization, with reference to FIGS. 2 and 3, these connections also being at intersections of hyperboloidal directrices.

| Member | Member | Connection | Member | Connection |
|---|---|---|---|---|
| 12a | 12d | 19 | 12j | 25 |
| 12b | 12k | 20 | 12e | 26 |
| 12c | 12f | 21 | 12l | 27 |
| 12d | 12a | 19 | 12g | 28 |
| 12e | 12h | 22 | 12b | 26 |
| 12f | 12c | 21 | 12i | 29 |
| 12g | 12j | 23 | 12d | 28 |
| 12h | 12h | 22 | 12k | 30 |
| 12i | 12l | 24 | 12f | 29 |
| 12j | 12g | 23 | 12a | 25 |
| 12k | 12b | 20 | 12h | 30 |
| 12l | 12i | 24 | 12c | 27 |

Accordingly, the connections 13–18 are in one plane normal to axis 131 of the structure; connections 19–24 are in another plane normal to axis 131 and connections 25–30 are in a third plane normal to axis 131.

Figure 8:
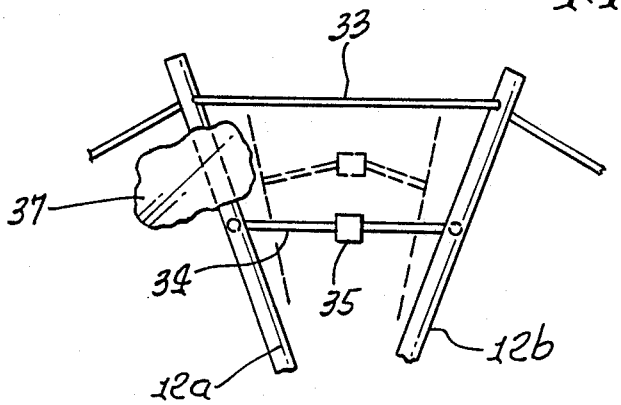
FIG. 8 is a side elevation showing, an articulated rigidizing member attached to two members of the framework.

An actuator or actuator 32 (see FIG. 9) may be provided between different members to relatively separate them, or collapse them, as between FIG. 1 and FIG. 3 states; and strings 33 may be provided to interconnect the members near their outer ends to become tensioned and limit expansion of the framework 11. See FIG. 8. Also, rigidizing links 34, which may be articulated at 35, may interconnect successive members to rigidize them and the assembly.

Figure 9:
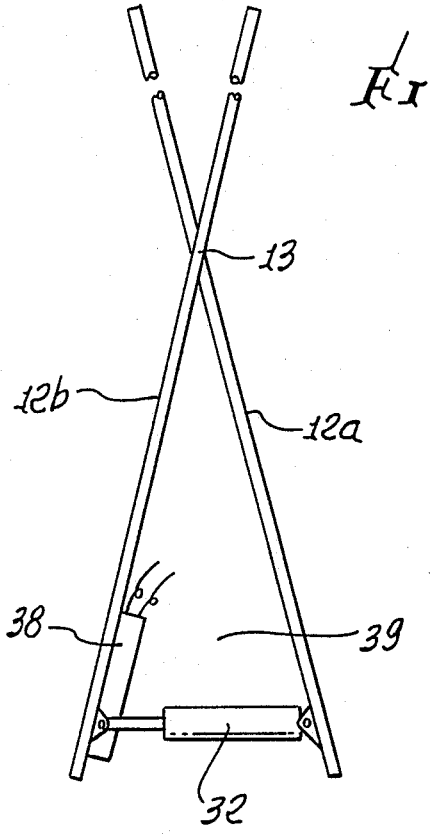
FIG. 9 is an elevation showing two members with an expanding actuator connected between them.

The invention also contemplates provision of electromagnetic wave antenna or reflector surfaces on the framework. The members 12*a*–12*l* may consist of aluminum or some other metal or alloy, to provide the antenna or reflector surfaces, in expanded condition; or there may be auxiliary antenna or reflector structure such as foldable extended surface 37 attached to the members. See FIG. 8. FIG. 9 shows electronic circuitry 38 carried by one of the members, i.e. 12*b*, in a "habitat" region 39 below the main extent of the antenna structure or framework. That circuitry may be electrically connected with the antenna structure.

Figure 7:
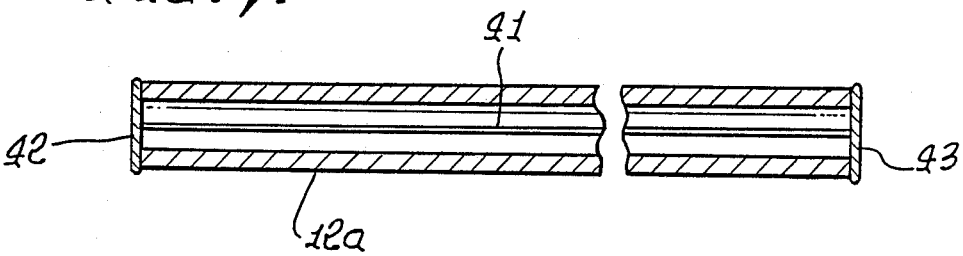
FIG. 7 is an enlarged section taken axially lengthwise through one of the framework members, in tubular form.

FIG. 7 shows a modified member 12*a'* having lightweight tubular form. It may be placed and kept in endwise compression, as for example by means such as a flexible line or cable 41 maintained in tension between end caps 42 and 43 on the tubing ends, the cable attached to such caps. All of the framework members may have this construction.

Figure 4:
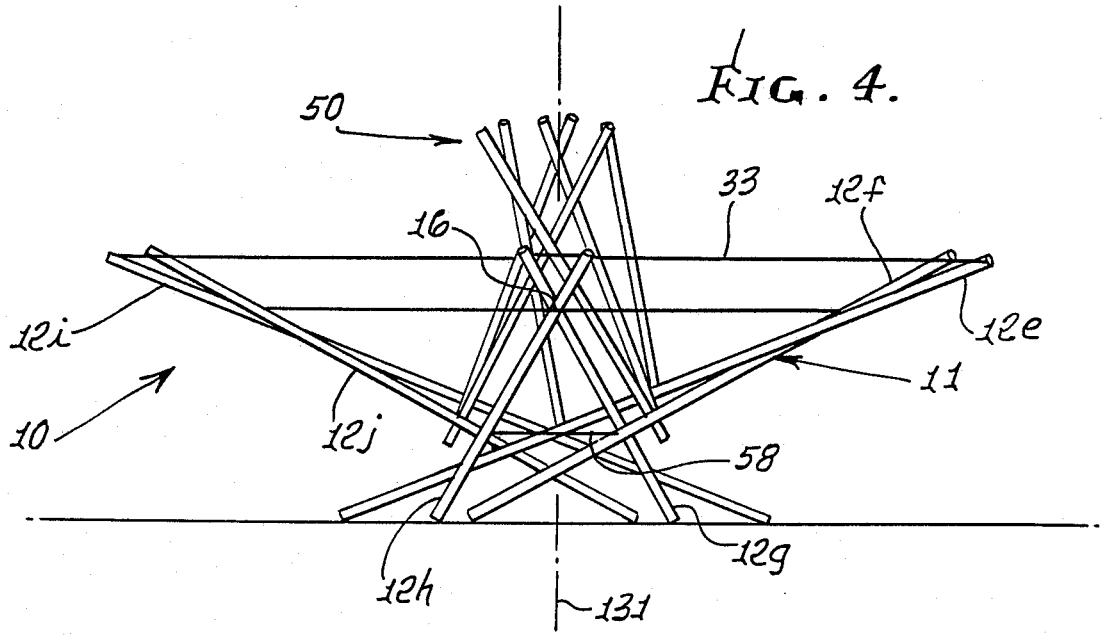
FIG. 4 is a view like FIG. 5 but enlarged to show central portions of two integral frameworks.
Figure 5:
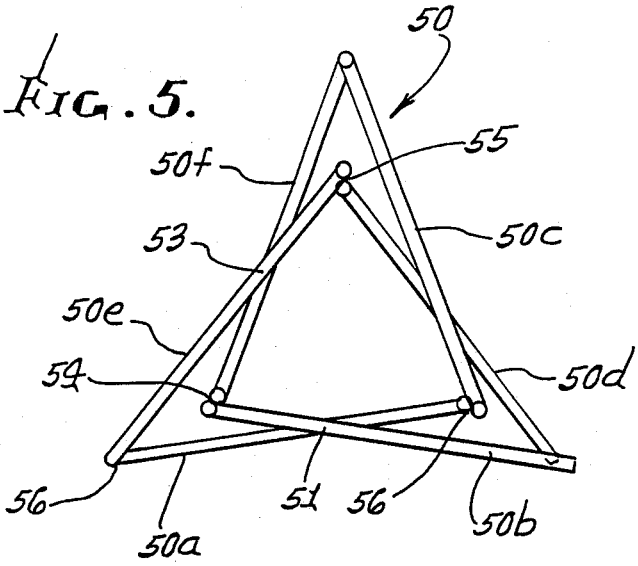
FIGS. 5 and 6 are perspective views showing a second framework in different states of expansion.
Figure 6:
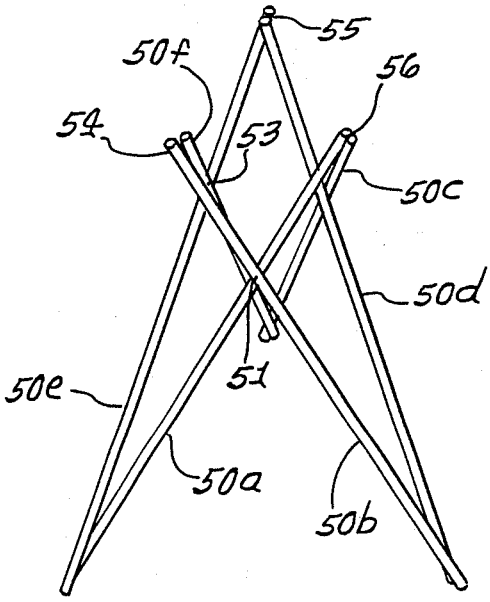

The invention also contemplates the provision of a second framework including multiple frame members having pivotal attachment to one another and also to members of the first framework, whereby the second framework is also deployable between multiple positions as the first framework is deployed between said collapsed and expanded conditions. See FIGS. 4–6. The second framework 50 includes members 50*a* to 50*f* which project generally upright in all positions of the first framework members—i.e. between expanded and collapsed position. Members 50*a* and 50*b* are pivotally interconnected at 51 at their mid-regions, and members 50*e* and 50*f* are pivotally interconnected at 53, at their mid-regions. Also, members 50*b* and 50*f* are pivotally connected at 54 near their uppermost extents; 50*d* and 50*e* are pivotally connected at 55 near their uppermost extends; and 50*c* and 50*a* are pivotally connected at 56 near their uppermost extends. FIG. 3 shows three locations where members of the second framework may be pivotally connected to members of the first framework, as by structure shown in FIG. 10. Lower ends of 50*a*–50*f* are pivotally connected to the following members.

| Members | Connected to members |
|---|---|
| 50a | 50e |
| 50b | 50d |
| 50c | 50f |
| 50d | 50b |
| 50e | 50a |
| 50f | 50c |

A resiliently yieldably retainer band such as a draw string or a rubber band 58 may extend abou the first framework at connection points 19–24.

The second framework carries electromagnetic wave tranmission means 60 near the upper ends of certain of the members 50*a*–50*f*, for transmitting wave energy toward the first framework antenna members 12*a*–12*l*, for reflection toward d distant target, generally linearly; or for receiving reflected wave energy from the members 12*a*–12*l*. The means 60 may be electrically connected with circuitry 38.

Figure 11:
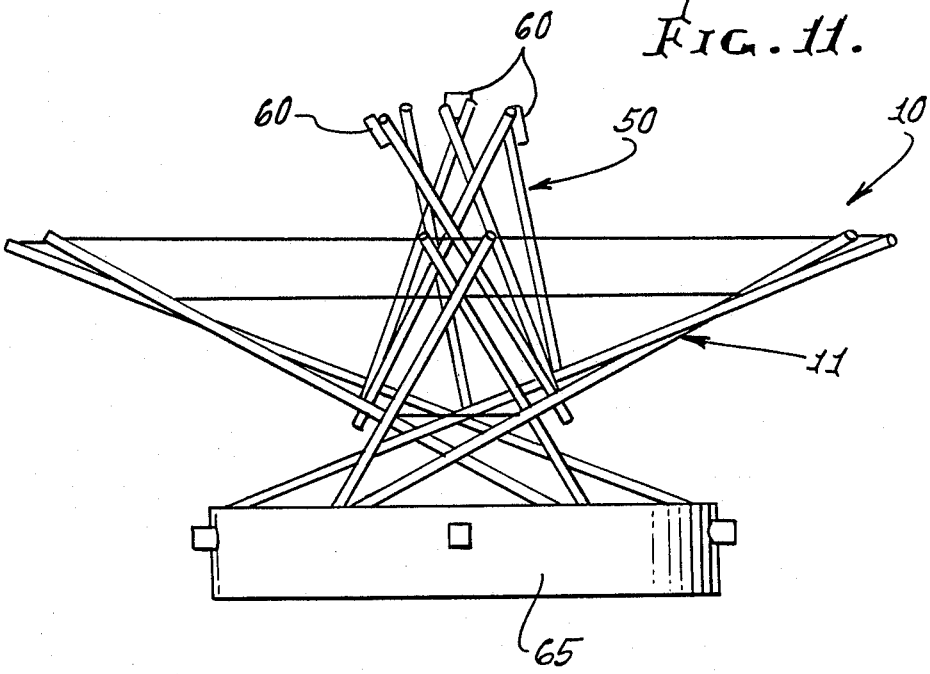
FIG. 11 is an elevation showing the antenna, and associated structures, schematically.

Appropriate attitude guidance means may be connected with the apparatus, to orient it in space. Such apparatus (small trim rockets and their controls) is designated as by package 65, in FIG. 11.

Figure 1A:
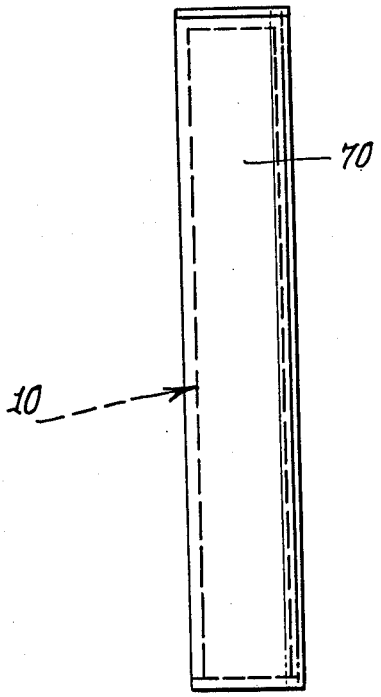

In FIG. 1*a* container 70 receives the collapsed antenna 10, for synchronistic deployment in space. It may consists of "stealth" material, or have a surface of such material.

We claim:

1. In a hyperboloidal deployable antenna, related to an hyperboloid of revolution having ruled lines, the combination comprising:

(a) a first upright framework including multiple elongated frame members extending along the ruled lines of said hyperboloid of revolution, said members having opposite free ends and being unitary and straight between said opposite free ends, (b) the members having pivotal interconnections at member side-by-side locations between said opposite ends, (c) whereby the framework is deployable between collapsed and expanded conditions, (d) and a second upright framework including multiple elongated second frame members having opposite ends and having pivotal attachment to one another at second member side-by-side locations between said opposite ends, and also having side-by-side pivotal interconnections to members of the first framework, whereby the second framework is also deployable between multiple positions as the first framework is deployed between said collapsed and expanded conditions, there being like pairs of the frame members of the second framework and characterized in that the members of each pair are pivotally interconnected at their lower end portions, below the level of interconnections of the members of the first and second framework, (e) each member of the first framework having pivotal connection with at least two other members of the first framework, at connection locations spaced along the length of each member of the first framework, (f) and wherein said connection locations include first locations and second locations, said first locations defining a first plane normal to an axis defined by said hyperboloid of revolution, and said second locations defining a second plane normal to said axis, said first and second planes having relatively greater axial spacing therebetween in said collapsed condition of the framework, and relatively lesser spacing therebetween in said expanded condition of the framework.

2. The combination of claim 1 including means to effect member deployment between said conditions.

3. The combination of claim 1 including electromagnetic wave antenna surfaces on said first framework.

4. The combination wherein the members of the first framework of claim 1 define a hyperboloidal framework deployed for use as a structural framework for space apparatus.

5. The combination of claim 1 including reflector surfaces on the first framework.

6. The combination of claim 1 including actuator means connected with members of at least one said framework to displace the framework between said collapsed and expanded conditions.

7. The combination of claim 1 wherein said members comprise tubes.

8. The combination of claim 7 including means maintaining said tubes compressed, lengthwise.

9. The combination of claim 8 wherein said means comprise flexible lines extending within said tubes, said lines being tensioned.

10. The combination of claim 1 wherein there are at least three of said pivotal connection locations, along the length of each member.

11. The combination of claim 1 wherein the members of the first and second frameworks have major lengths, and the hyperboloid of revolution has a central axis, the members of the second framework extending closer, along their major lengths to said axis than the members of said first framework along their major lengths, in said expanded condition of the first framework.

12. The combination of claim 3 wherein said second framework carries electromagnetic wave transmission means located to receive or transmit electromagnetic waves reflected by the electromagnetic wave antenna surfaces of the first framework members.

13. The combination of claim 3 including electronic circuitry carried by said members.

14. The combination of claim 1 including an elongated container removably carrying said frameworks in collapsed condition, the container having an end opening to discharge the frameworks.

* * * * *